US007017905B2

(12) United States Patent
Lindsey

(10) Patent No.: US 7,017,905 B2
(45) Date of Patent: Mar. 28, 2006

(54) ELECTRONIC DIE

(75) Inventor: Michael Karel Lindsey, Barrington, IL (US)

(73) Assignee: Blinky Bones, Inc., Barrington, IL (US)

( * ) Notice: Subject to any disclaimer, the term of this patent is extended or adjusted under 35 U.S.C. 154(b) by 0 days.

(21) Appl. No.: 10/227,129

(22) Filed: Aug. 24, 2002

(65) Prior Publication Data

US 2004/0036213 A1 Feb. 26, 2004

(51) Int. Cl.
*A63F 9/04* (2006.01)

(52) U.S. Cl. ..... 273/146; 273/138.2; 463/22

(58) Field of Classification Search ..... 273/236, 273/237–239, 146, 460, 143 R, 145, 145 R; 463/22, 14, 18, 16, 47, 31
See application file for complete search history.

(56) References Cited

U.S. PATENT DOCUMENTS

| | | | | |
|---|---|---|---|---|
| 2,338,811 | A | 1/1944 | Hasbrook | 33/206 |
| 2,611,188 | A | 9/1952 | Bell | 33/206 |
| 2,881,892 | A | 4/1959 | Ylinen | 194/17 |
| 2,903,820 | A | 9/1959 | Bodell | 46/228 |
| 3,096,591 | A | 7/1963 | Higgins, Jr. et al. | 33/206 |
| 3,225,450 | A | 12/1965 | Stanley | 33/206 |
| 3,225,460 | A | 12/1965 | Randell et al. | 35/22 |
| 3,253,280 | A | 5/1966 | Feyling | 346/108 |
| 3,271,650 | A | 9/1966 | Riddle | 318/489 |
| 3,290,786 | A | 12/1966 | Parkin | 33/206 |
| 3,304,651 | A | 2/1967 | Deyerl | 46/228 |
| 3,357,703 | A | 12/1967 | Hurley | 273/138 |
| 3,400,932 | A | 9/1968 | Conrad | 273/146 |
| 3,450,408 | A | 6/1969 | Hagerman | 273/146 |
| 3,459,427 | A | 8/1969 | Rhodes | 273/138 |
| 3,478,437 | A | 11/1969 | Cothran | 33/206 |
| 3,487,303 | A | 12/1969 | Remington | 324/65 |
| 3,495,832 | A | 2/1970 | Thomassen-Behle | 273/146 |

(Continued)

FOREIGN PATENT DOCUMENTS

| | | |
|---|---|---|
| DE | 19540025 | 6/1997 |

(Continued)

OTHER PUBLICATIONS

Web page ad for "Palco Marketing Retail Site", http://www.palcomarketing.com/dice.htm, 4 pages, Nov. 2, 2001.

(Continued)

*Primary Examiner*—Xuan M. Thai
*Assistant Examiner*—Alex F. R. P. Rada, II
(74) *Attorney, Agent, or Firm*—Gavrilovich, Dodd & Lindsey LLP

(57) ABSTRACT

An electronic die capable of exhibiting visual and/or sound effects is disclosed. The die retains the conventional dice-action aspect of being rolled to randomly select an upwardly facing facet. The electronic components provide entertainment effects. Electronic displays, which can include light-emitting dots, are located on the sides of the die for showing the visual effects. An electronic circuit, contained within the die, controls output of the displays. One or more batteries are also contained inside the die for powering the displays and the electronic circuit. To ensure that the die is suitable for playing dice games, the displays, electronic circuit and batteries are securely mounted to withstand the die being thrown. The die can have a hollow compartment for holding the batteries and electronic circuit, or alternatively, the die can be formed using injection molding or casting techniques to embed the electrical components in a solid plastic body.

30 Claims, 10 Drawing Sheets

U.S. PATENT DOCUMENTS

| | | | | | |
|---|---|---|---|---|---|
| 3,592,473 | A | | 7/1971 | Jernakoff et al. | 273/138 A |
| 3,645,532 | A | | 2/1972 | McNaney | 273/142 A |
| 3,659,853 | A | | 5/1972 | Church | 273/138 A |
| 3,709,499 | A | | 1/1973 | Lukens, Jr. | 273/138 A |
| 3,715,624 | A | | 2/1973 | Herman | 315/209 |
| 3,791,650 | A | | 2/1974 | Dice | 273/138 A |
| 3,896,574 | A | | 7/1975 | McNaney | 40/34 |
| 4,034,988 | A | | 7/1977 | Goldner et al. | 273/138 A |
| 4,124,881 | A | * | 11/1978 | Haber et al. | 362/253 |
| 4,148,488 | A | | 4/1979 | Kohlhagen | 273/146 |
| 4,181,304 | A | | 1/1980 | Haber | 273/146 |
| 4,431,189 | A | | 2/1984 | Wiencek et al. | 273/138 A |
| 4,506,890 | A | | 3/1985 | Murry | 273/138 A |
| 4,603,484 | A | | 8/1986 | Strothmann | 33/366 |
| 4,641,840 | A | * | 2/1987 | Larson | 463/22 |
| 4,669,728 | A | | 6/1987 | Carden | 273/138 A |
| 4,672,753 | A | | 6/1987 | Kent et al. | 33/366 |
| 4,858,931 | A | | 8/1989 | McKechnie | 273/138 A |
| 4,909,513 | A | | 3/1990 | Kiyono | 273/145 R |
| 5,031,914 | A | | 7/1991 | Rosenthal | 273/146 |
| 5,155,442 | A | | 10/1992 | Mercer | 324/690 |
| 5,238,249 | A | | 8/1993 | Elias et al. | 273/138 A |
| 5,344,145 | A | | 9/1994 | Chadwick et al. | 273/138 A |
| 5,348,300 | A | | 9/1994 | Jennings | 273/146 |
| 5,428,902 | A | | 7/1995 | Cheah | 33/366 |
| 5,625,955 | A | | 5/1997 | Han | 33/366 |
| 5,885,157 | A | | 3/1999 | Harada et al. | 463/22 |
| 5,890,716 | A | * | 4/1999 | Bofinger et al. | 273/146 |
| 6,066,955 | A | | 5/2000 | Zeller et al. | 324/716 |
| 6,126,561 | A | | 10/2000 | Mark | |
| 6,220,594 | B1 | * | 4/2001 | Peng | 273/146 |
| 6,331,145 | B1 | | 12/2001 | Sity et al. | 463/22 |
| 6,394,903 | B1 | * | 5/2002 | Lam | 463/22 |
| 6,588,748 | B1 | * | 7/2003 | Solow et al. | 273/146 |
| 6,685,353 | B1 | * | 2/2004 | Arroyo | 368/276 |
| 6,712,478 | B1 | | 3/2004 | Sheu et al. | |
| 2001/0014622 | A1 | | 8/2001 | Hazama | 463/36 |

FOREIGN PATENT DOCUMENTS

| | | | | |
|---|---|---|---|---|
| DE | 19540025 | A1 | * | 6/1997 |
| GB | 2288547 | | | 10/1995 |
| JP | 2000084241 | | | 3/2000 |
| KR | 99010168 | A | * | 2/1999 |
| WO | WO 99/11344 | | | 3/1999 |
| WO | WO 00/52672 | | | 9/2000 |

OTHER PUBLICATIONS

Web page ad from http://audiovideoone.com/store/p000282.htm, showing Liteglow Illuminated Fuzzy Dice, 1 page, Nov. 2, 2001.

Web page ad from http://www.wolo-mfg.com/light.htm, showing "Dice That Lite" fuzzy dice, 1 page, Nov. 2, 2001.

Web page ad from http://www.qkits.com/serv/qkits/velleman/pages/K3400.asp, showing Dual Electronic Dice Kit, 1 page, Nov. 2, 2001.

Web page ad from http://gibsonteched.net/vmk109.html, showing Electronic Dice Kit available from Gibson Tech Ed, Inc., 2 pages, Nov. 2, 2001.

Web page ad from http://www.qkits.com/serv/qkits/maplin/pages/LM99.asp, showing Electronic Digidice Kit, 1 page, Nov. 2, 2001.

Copy of the front and back of packaging for ELECTRO™DICE from Palco Marketing, Inc, 1 page, no date.

Web page ad for Toy Dice from Russell Martin & Associates, http://store.yahoo.com/russellmartinandassociates/flashingdice1.html, 1 page, Jan. 7, 2003.

* cited by examiner

ELECTRONIC DIE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

REFERENCE TO COMPUTER PROGRAM LISTING APPENDIX

Submitted herewith, in duplicate, as a Computer Program Listing Appendix, is a computer program listing on one (1) compact disc storing one (1) file entitled "DICE6.txt", created on Aug. 22, 2002 and having a size of 19,106 bytes, which is hereby incorporated by reference.

TECHNICAL FIELD OF THE INVENTION

The present invention generally relates to games, toys and novelty devices, and in particular, to dice suitable for playing games.

BACKGROUND OF THE INVENTION

Dice have been known and used for thousands of years. In some form or another, dice have appeared in many different cultures throughout history. For example, dice are depicted on some ancient Egyptian monuments, and they were used for playing games and gambling throughout ancient Greece and Rome.

In contemporary times, dice are available in variety of different shapes and sizes. The number of sides (facets or faces) on a die can range from just a few to dozens, and the size of a die can vary widely, from the very minute to the very large. A fairly standard size for a conventional six-sided die is about 16 millimeters along an edge. Dice are known to have numbers, letters, dots, or other symbols printed, drilled or embossed on their sides.

Conventional modern gaming dice are cubes having dots on their sides representing the numbers one through six. The dots are placed on respective die faces so that the sum of the dots on opposite sides is always seven. Thus, the numbers one and six appear on opposite sides of the cube, while two is opposite five and three is opposite four.

With the advent of electronics, various types of "electronic dice" have been developed to increase the entertainment value and interest in using dice.

For example, the ELECTRO™ DICE, available from Palco Marketing, Inc. of Plymouth, Minn. (www.palcomarketing.com/dice.htm or www.electrodice.com), feature a pair of spherically-shaped dice, each having an exposed square cavity formed opposite a flat side on the sphere. Within the square cavity are seven light-emitting diodes (LEDs) arranged to represent the dots on the face of a conventional die. Batteries, a movement sensor, a piezoelectric noisemaker, and an electronic circuit for randomly generating numbers are contained within the spherical body. When the ELECTRO™ DICE are tossed, they land upright on their flat sides and randomly display numbers using the LEDs, while making sounds. Although the ELECTRO™ DICE provide an innovative and entertaining approach to electronic dice, they forego the conventional dice-action aspect of being rolled to randomly select a facet, and instead rely on electronics to randomly generate numbers.

Japanese Patent No. JP2000084241 to Kimura Masaki discloses a game machine having a dice-like look and feel. The cubic housing of the game machine is about six centimeters on a side and contains an IC circuit (sic) programmed with a game and power source. The dots of the die are lighted push buttons for operating the game. A liquid crystal display (LCD) and two switches—a game selection switch and an on-off switch—are located on one exterior side of the housing.

U.S. Pat. No. 6,394,903 discloses a six-sided toy die that includes six different playing functions, one associated with each side. The playing functions are essentially different games for children. When the toy die is rolled, the game on the upward side can be played. The games include a letter matching game, a phone dialing game, and so forth. Internally, the die includes a controller and sound generator for producing music, voice and noises. The die is also includes an internal gravity switch, as well as LEDs associated with push buttons located on the exterior of the die. Although the toy die of the '903 patent has many appealing features, it is clearly not intended to be used for the random selection of a number or outcome, like a conventional die.

PCT Patent Application Nos. WO 00/52672 and WO 99/11344, and related U.S. Pat. No. 6,331,145 disclose a six-sided electronic die having a conventional appearance, but containing within itself a programmable micro-controller circuit and a radio frequency (RF) transceiver for transmitting data identifying which face is lying down on a surface. At least one tilt sensor is included in the die for indicating which face is down. The die does not include lights or any means for generating sounds or visual displays.

U.S. Pat. No. 6,220,594 discloses a device for automatically discriminating the spot pattern of an upward face of a six-sided die. The die includes an embedded transmitter and mercury switches for transmitting positional information. The die does not include any means for generating sounds or visual displays.

U.S. Pat. No. 4,858,931 discloses an electronic die having a cube-shaped, hollow housing that contains batteries and an electronic circuit for randomly generating two numbers from one to six inclusive. The top side of the housing includes two identical rectangular display sections with each section having seven light emitting elements mounted therein. The electronic circuit is actuated by manually shaking the die. When the shaking stops, the two random numbers that are finally selected are illuminated in the display sections. The electronic die of the '931 patent is not intended to be tossed or thrown like a conventional die, and instead, its electronics are used to randomly determine an outcome.

U.S. Pat. No. 4,641,840 discloses a cubic electronic die having seven-segment numeric displays on each of its six facets. Within the hollow cube are a battery, a motion sensing switch and an electronic circuit for generating random numbers. While the die is moving, the circuit generates a series of random numbers on the displays. Once the motion stops, the random number occurring last is displayed on all six facets.

U.S. Pat. No. 4,431,189 discloses a device for simulating the roll of a die. The device includes an electronic circuit housed within an elongated housing. The circuitry includes logic that simulates the random nature of rolling conventional dice. A multi-position switch is provided so that the logic circuitry can selectively simulate dice behavior characteristic of dice having different numbers of side, such as four-sided, eight-sided, twelve-sided, twenty-sided, or one-hundred-sided dice.

U.S. Pat. No. 4,181,304 discloses illuminated dice in combination with a storage housing for the dice. The dice are provided with light-emitting numeric displays on their surfaces, together with a battery, gravity-responsive switch and master switch contained within each die. The gravity-responsive switch causes the battery to be coupled to the upward facing side of the die, thereby illuminating only the upwardly facing numeric display. The separate housing includes small projections for reception in small holes formed on one face of each die to open the master switch in each die so that there will not be drainage on the batteries when the dice are stored.

U.S. Pat. No. 4,124,881 discloses a pair of multifaceted dice having illuminatable numeric displays. Each of the facets bear an illuminatable numeric display and each side supports an internal switch that operates to illuminate only the upward facing side of the dice after having been rolled and coming to rest.

U.S. Pat. No. 4,034,988 discloses an electronic dice game in which an electronic circuit and battery are supported within a rectangular housing having two sets of seven illuminatable display elements on single face to represent the spots of a conventional pair of dice. Control switches and a plug-in socket are externally located on another housing face. The electronic circuit includes a timer that simulates the random characteristic of rolling of conventional dice. In its intended use, the electronic dice of the '988 patent simulate the dice-playing activity by randomly generating combinations of illuminated spot elements on the single facet. An audible oscillator simulates the sound of rolling dice. Although the electronic dice game of the '988 patent may have appeal, it is not designed or intended to be tossed or thrown like conventional dice.

U.S. Pat. Nos. 3,715,624 and 3,459,427 disclose early efforts to combine electronic circuitry with playing dice, and each includes a random generator which randomly illuminates the spot patterns associated with conventional dice in a manner intended to simulate the action of rolling dice.

U.S. Pat. No. 3,450,408 discloses a hollow die having lighted faces of different colors. Located within the die is a composite mercury switch that operates to light only the upward facing side of the die. Nowadays, the known hazards of mercury make the die disclosed in the '408 patent undesirable for toys and novelty items.

U.S. Pat. No. 2,881,892 discloses a game apparatus including a cube with conventional dice dot patterns for the numbers two through six on its side and upper facets. The apparatus sequentially illuminates each of the dot patterns on the facets in a rapid, serial manner using a rotatable contact switch driven by an electric motor. A player attempts to activate a manual breaking device that stops the movement of the contact switch. The object is to apply the breaking device with sufficient skill to select the desired dot pattern.

Although the foregoing electronic dice may provide a certain degree of entertainment value, there is a need for an improved electronic die that further enhances the excitement and appeal of using dice.

SUMMARY OF THE INVENTION

It is an advantage of the present invention to provide an improved electronic die that, when in use, presents visual and/or sound effects. The electronic die can be used individually, or in sets of two or more, for amusement or to play dice games, such as board games or games of chance.

Unlike many known electronic dice, the die disclosed herein retains the conventional dice-action aspect of being rolled to randomly select a facet displaying a particular number or symbol. The electronics of the inventive die present visual and/or audio effects during use. These effects can be patterned to increase the appeal and entertainment value of the die. In addition, using miniaturized electronics and batteries, the die can also have physical dimensions that are the same as or similar to a conventional hand-tossed gaming die.

In accordance with an embodiment of the invention, a multi-faceted electronic die includes electronic displays located on its sides for showing visual effects. The displays can be light-emitting dots. An electronic circuit within the die controls output of the displays. Specifically, the electronic circuit causes the displays on at least two of the facets to flash on and off in a pattern. One or more batteries are also contained inside the die for powering the displays and the electronic circuit. To ensure that the die is suitable for playing dice games, the displays, electronic circuit and batteries are securely mounted to withstand the die being thrown. The die can include a body having a hollow compartment for holding the batteries and electronic circuit. Alternatively, the die can be formed using casting or injection molding techniques to encase the electrical components in a solid plastic body so that the electronic die has the approximate weight and feel of a conventional playing die.

In accordance with another embodiment of the invention, the electronic die is a programmable device having lights (i.e. visual displays) on its sides. A sensor, located inside the die, indicates at least one aspect of the physical orientation of the die, e.g., which side is facing up, whether the die has moved or is moving, rotational angle, etc. An electronic control circuit, also located inside the die, causes the lights to flash a display pattern based on output from the sensor. The control circuit can include a processor and a memory. The memory stores software defining a plurality of display patterns. Each display pattern defines a particular order and timing for turning on and off (or visa versa) the lights. The processor executes the software to select from the alternative display patterns and flash them using the lights. The electronic die can also include an audio generator for making sounds or synthesizing speech or music. The processor is programmable so that the visual and audio displays can be reconfigured by changing the software in memory. This permits the die to be adapted for presenting different effect patterns, as well as for playing different games and uses.

Other embodiments, features and advantages of the invention will be or will become apparent to one with skill in the art upon examination of the following figures and detailed description. It is intended that all such additional features, embodiments and advantages be included within this description, be within the scope of the invention, and be protected by the accompanying claims.

BRIEF DESCRIPTION OF THE DRAWINGS

The components in the figures are not necessarily to scale, emphasis instead being placed upon illustrating the principles of the invention.

DETAILED DESCRIPTION OF THE PRESENT EMBODIMENT(S) OF THE INVENTION

Figure 1:
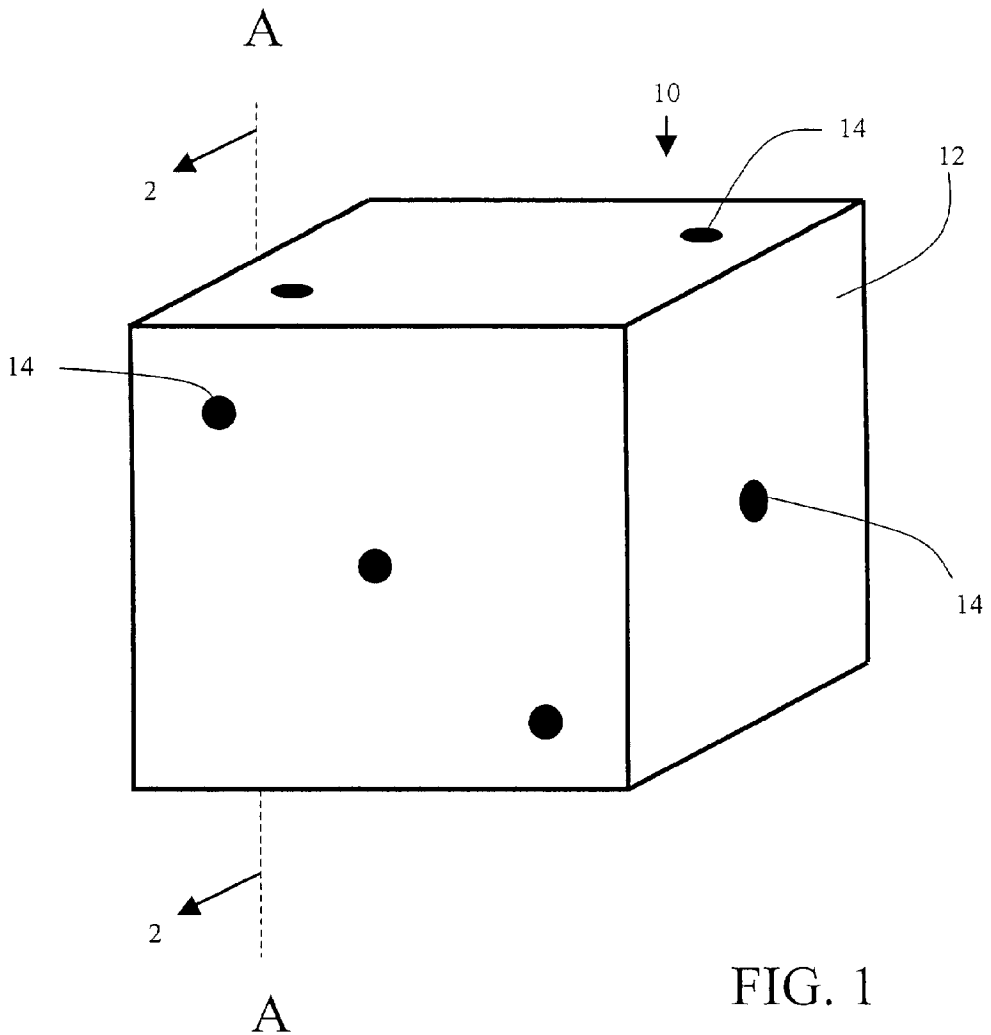
FIG.1 is a perspective view of an electronic die in accordance with a preferred embodiment of the invention.

Turning now to the drawings, and in particular to FIG. 1, there is illustrated an electronic die 10 in accordance with a preferred embodiment of the invention. The die 10 includes lights 14 located on its faces 12. As shown, the lights 14 are arranged in a conventional dot pattern representing numbers one through six.

In use, the die 10 is rolled to randomly select an upwardly-facing side indicating an outcome, displayed as a particular number of dots. The electronics inside the die 10 cause the lights 14 to flash in a pattern or sequence. The pattern can be designed to increase the overall appeal of using the die 10. In addition, using miniaturized electronics and batteries, the die 10 can also have physical dimensions that are the same as or similar to a hand-tossed gaming die.

The patterns displayed by the lights 14 can include predefined sequences of flashing the lights 14 on and off in particular orders for specific durations. For example, a display pattern can flash the dots on three adjacent sides of the die 10 in a circular pattern, with each face lighting up in sequence. The lights 14 can be controlled individually, or can be controlled in groups; for instance, all of the lights 14 on a face can flash on and off together. Alternatively, the lights 14 can display a random flashing sequence.

The die 10 is capable of storing and displaying one of more patterns. Accordingly, each time the die 10 is rolled, the display pattern can change.

The lights 14 can include any suitable light-emitting device, such as miniature bulbs, light emitting diodes (LEDs), or the like. Each of the lights 14 is preferably an individual LED. Alternatively, a single light can be used for each side, with plastic, light-transmissive piping channeling light from the light source to each of the dots on a respective face. In this alternative arrangement (not shown), six lights are set into the interior of the die 10, one for each side. A transparent light manifold is attached to each light. The light manifolds are formed of plastic, each having an end for attaching to the light source and one or more fingers terminating with flat ends representing the dots. The manifolds pipe the light from the light sources to the dots. For the six-sided die 10 of FIG. 1, only six lights are needed, rather than the twenty-one required if each dot is represented by an individual light.

The color of the lights 14 can be one that is desirable and available for the chosen light source.

Although the die 10 is shown as a conventional six-sided die, the present invention does not place any limits on the number of faces or on the displayed indicia. Dice conforming to the principles of the invention can have any suitable number of side, as well as various shapes and sizes. In addition, dice conforming with the principles of the invention can also display indicia other than dots, such as numbers, letters, images, pictures or other symbols that can be presented using suitable visual displays, such as miniature, incandescent bulbs, LEDs, LCDs, or the like, located on the sides of the die.

Figure 2:
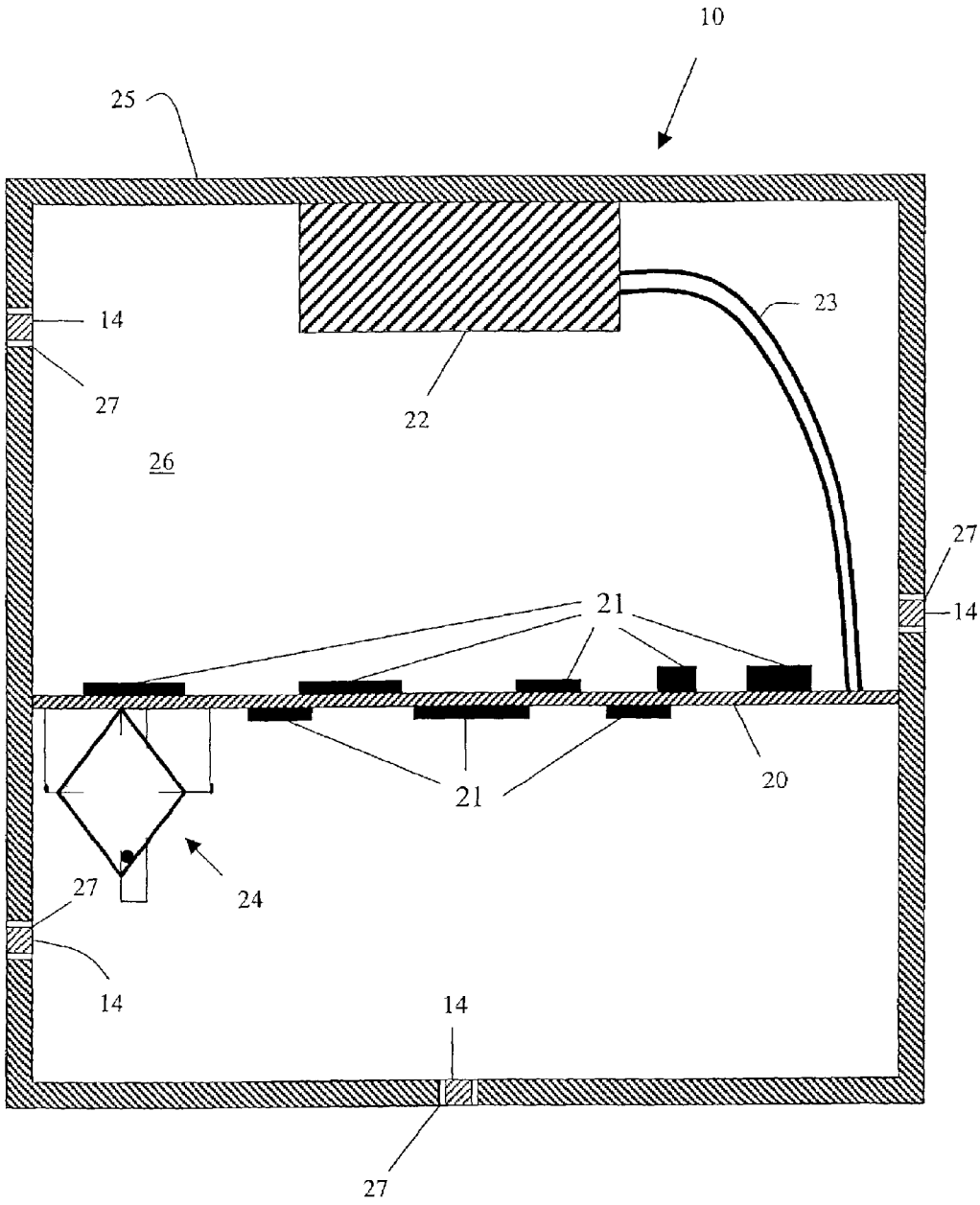
FIG. 2 is a cross-sectional view of the electronic die of FIG. 1.

FIG. 2 is a cross-sectional view of the electronic die 10 of FIG. 1 taken in direction 2 along axis A. The die 10 has a cube-shaped body 25, a compartment 26 located within the cubeshaped body 25, a plurality of light-emitting dots 14 mounted on the sides of the cube-shaped body 25, a sensor, preferably a gravity switch 24, mounted within the compartment 26, and an electronic circuit, mounted within the compartment 26, for causing at least one of the light-emitting dots 14 to flash on and off based on output from the gravity switch 24.

As shown, the inside of the die 10 is hollow. Specifically, the die 10 includes a hollow body or shell 25 having an enclosed internal compartment 26. Inside this hollow space 26 is the electronic circuit comprising a circuit board 20 having affixed thereto one or more electronic components 21 for providing visual and audio effects. A power source, such as a battery 22, is connected to the circuit board 20 by wires 23.

Although the die 10 can be made in different sizes, a die body having an approximate volume of less than one cubic inch facilitates the die being hand tossed in the conventional manner.

The gravity switch 24 is included for indicating which of the sides is facing up. The switch 24 is placed in the hollow cavity 26 and electrically connected to the circuit board 20. The display pattern generated by the circuit board 20 can be based on output of the gravity switch 24. The gravity switch 24 can be any suitable device for detecting the upward side of the die 10, and is preferably the switch shown in FIGS. 12A–B.

Other embodiments of the electronic die do not include the gravity switch 24. These embodiments include circuitry that is capable of generating visual and/or audio effects without relying on the output of a gravity switch. It is intended that these other embodiments fall within the scope and spirit of the present invention.

The light-emitting dots 14 are mounted in holes 27 formed in the body 25. An adhesive secures the light-emitting dots 14 so that they remain in the holes 27 during use. The light-emitting dots 14 can be light emitting diodes (LEDs) electrically connected to the circuit board 20 by wires or metal leads (not shown).

The circuit board 20, battery 22, and gravity switch 24 are securely mounted within the body 25 so that the die 10 can be tossed without damaging these components. An adhesive, such as an epoxy, hot glue, or the like, can be used to glue the circuit board 20 and battery 22 to the wall(s) of the body 25. Alternatively/additionally the battery 22 can be glued to the circuit board 20. The gravity switch 24 can be glued to the wall(s) of the body 25 and/or the circuit board 20. Other means, such as lugs and/or slots formed on the interior surfaces of the body sides for mating to the surfaces of the circuit board 20, battery 22, or gravity switch 24 can be used to secure the components within the compartment 26.

The body 25 can be made of opaque or transparent plastic. Transparent plastic allows users to see the internal components, which enhances the entertainment value of the die 10, especially with children. In addition, an unexpected benefit of a transparent body is that, with the lighted dots 14 mounted in the holes 27 as shown in FIG. 2, the light-emitting dots 14 create an "edge effect" outlining the shape of the body 25. More specifically, the light from the light-emitting dots 14 diffuses through the walls of the body 25 and then lights up the edges where the walls intersect. For the die 10, this effect provides an outline of the cube and is particularly entertaining in a darkened environment.

The power source can include any suitable battery conforming to the internal space limitations of the body 25 and the voltage and current requirements of the electronic components. For example, a pair of standard A76 1.5 volt watch batteries can be used.

Figure 3:
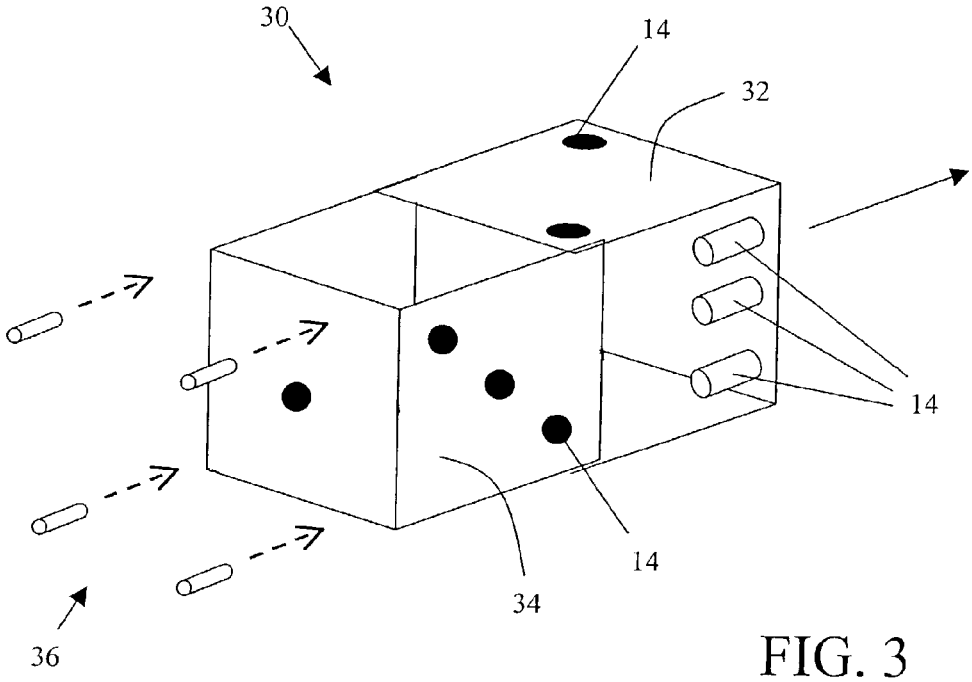
FIGS. 3–4 are partial exploded views of electronic dice having hollow bodies.
Figure 4:
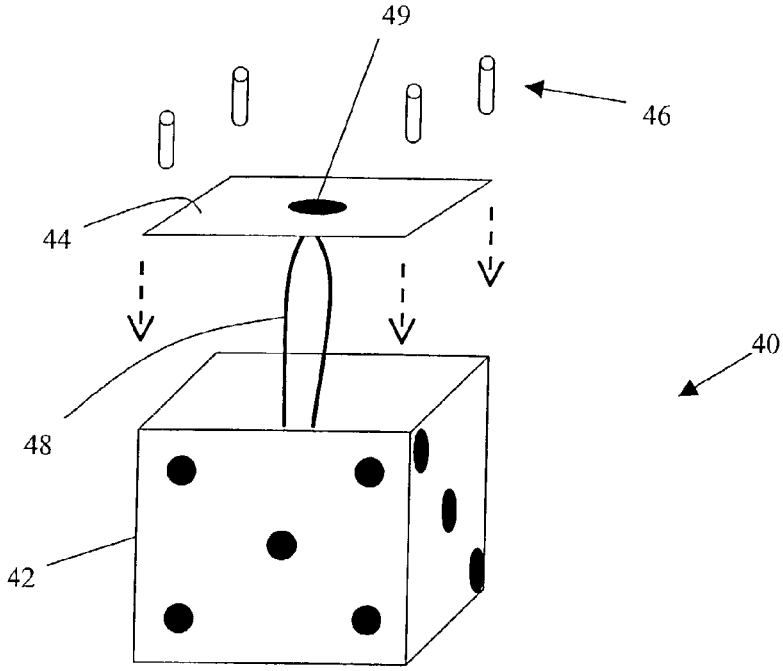

FIGS. 3–4 are partial exploded views of electronic dice 30, 40 having hollow bodies, in accordance with some embodiments of the present invention. Each of the dice 30, 40 features removable sides so that the electronic components inside can be accessed. This permits the batteries to be changed or the die to be reprogrammed with different display patterns or games.

FIG. 3 shows a first exemplary configuration of an electronic die 30 that includes a body of two mated pieces 32, 34 that slide together to enclose the electronics (not shown). For a six-sided die, each of the two pieces consists of three of the sides, forming a u-shaped piece. The two pieces 32, 34 engage along the exposed edges of two of their respective sides. The edges are beveled to provide a better guide and squared exterior edges when the pieces 32, 34 are mated together. When the pieces 32, 34 are closed together, one or more fasteners 36, such as screws, can be used to secure the pieces 32, 34 together.

The lighted dots are connected to the circuitry using wires (not shown) having lengths sufficient to allow the pieces 32, 34 to be separated far enough apart so that a user can access the internal components, such as the batteries. Alternatively, the lights wired on one side can be connected to the internal circuit board (not shown) using detachable jacks. This permits the one side to be completely separated from the other side by unplugging the jacks.

FIG. 4 shows a second exemplary configuration for an electronic die 40 having a hollow body. The body comprises a box 42 and a lid 44 that can be fastened to the top of the box 42 to form an enclosure containing the electronic components (not shown). One or more fasteners 46, such as screws, are used to secure the lid 44 to the box 42. A wire 48 connects the lighted element 49 of the lid 44 to the internal circuit board (not shown). The wire 48 can be of sufficient length so that the lid 44 can be separated far enough from the box 42 to provide convenient access to the internal components, such as the batteries. A jack (not shown) can be attached to the wire 48 for allowing the lighted element 49 to be unplugged from the circuit so that the lid 44 can be completely separated from the box 42.

Figure 5:
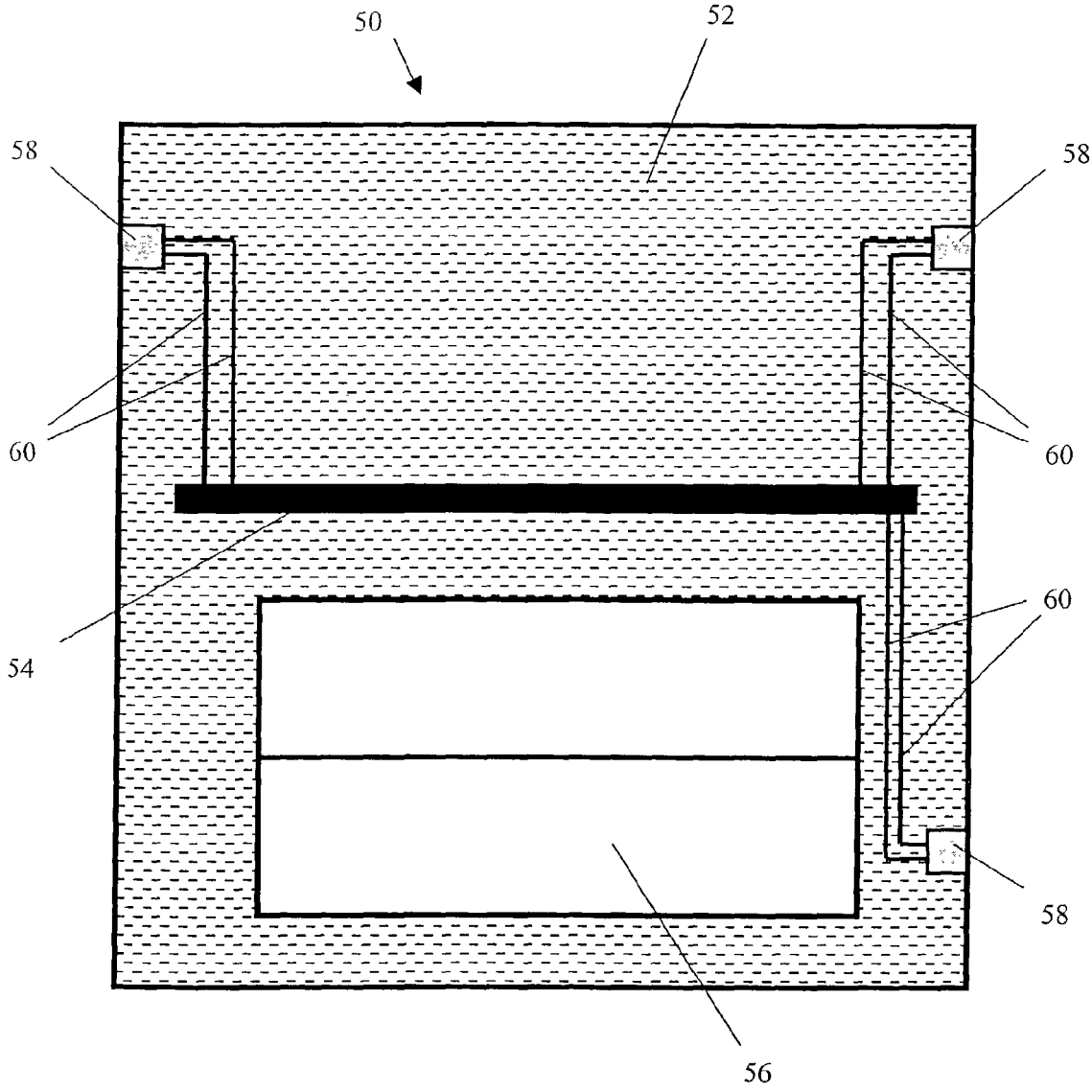
FIG. 5 is a cross-sectional view of an electronic die having a solid body.

FIG. 5 is a cross-sectional view of an electronic die 50 having a solid body 52, in accordance with a further embodiment of the invention. The solid plastic body 52 encases the electronic components, e.g., the electronic circuit 54, the battery(s) 56 and at least a portion of each of the lights 58. The electronic components can be the same as those described elsewhere herein. As shown in FIG. 5, the lights 58 provide the displays located on the sides of the body 52 for showing visual effects. The electronic circuit 54, contained within the body 52, controls the output of the lights 58. Each of the lights 58 is connected to the electronic circuit 54 by respective wires or leads 60. The lights 58 can be any suitable display devices, such as bulbs, LEDs, LCDs, or the like.

Although the internal components of the electronic die 50 can not be readily accessed or serviced, the solid body 52 has a weight and feel similar to a conventional die, making it desirable for playing dice games that require the die to be thrown by hand. In addition, the die 50 can be made to a size the same as or approximately the same as a conventional die, further enhancing its desirability.

The body can be cast in a plastic material. A casting resin, such as Alumilite available from Alumilite Corporation of Kalamazoo, Mich. can be used. Other materials can be used, such as a different type of liquid thermoset resin, cellulose acetate, an epoxy, a urethane, a polyurethane, or a silicone based material.

A casting mold having the desired size and shape of the die is used. For Alumilite, the mold can be made of silicon. Molds fabricated from other materials can also be used.

To cast the electronic die, the electrical component parts are first connected together, e.g., soldered to the circuit board and/or to one another, into a single unit, shown as components 54–58 in FIG. 5. The parts are fixed in their proper positions relative to one another, for example, so that the lights are arranged in the correct pattern and so that they are properly displayed on the exterior faces of the body. The single unit of parts is the positioned in the mold, and then the casting material is poured into the mold over the components. After the material sets, the die is removed from the mold. The exterior of the die can then be finished, if necessary, with polishing, marking or any other desirable treatment.

Other manufacturing techniques can be used to form the solid body. For example, injection molding could be used to encase the components of the die in plastic. The process would be similar to that used for casting. The components would first be formed into a single unit and then placed into the mold. After injection of the plastic, the exterior of the die could be finished, if necessary.

Figure 6:
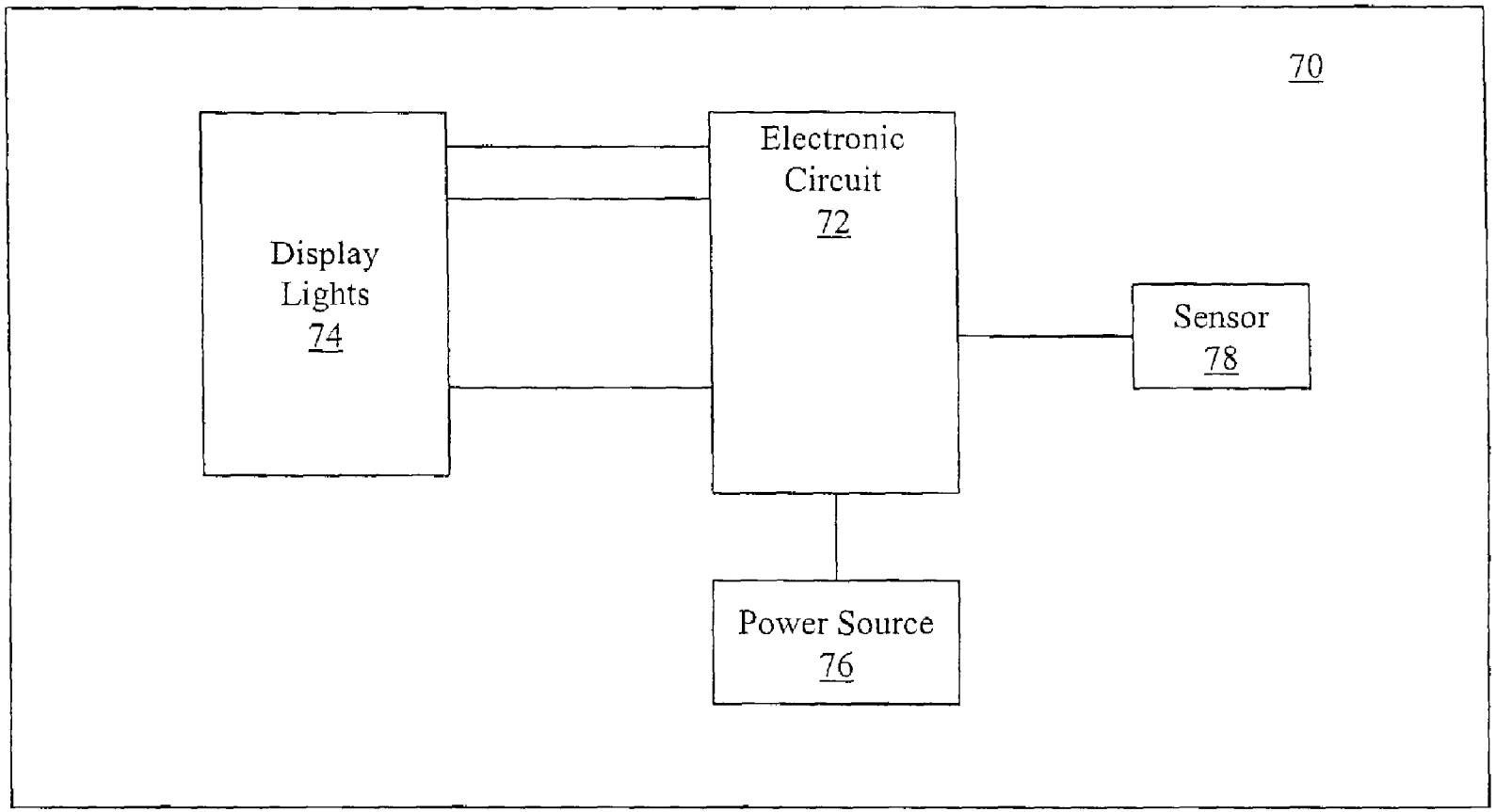
FIG. 6 is a block diagram depicting a first circuit includable in the embodiments of the electronic die disclosed herein.

FIG. 6 is a block diagram depicting a first set of electronic components 70 includable in the embodiments of the electronic die disclosed herein. The components 70 include an electronic circuit 72, displays 74, a power source 76, such as one or more batteries, and one or more sensors 78.

The electronic circuit 72 includes any suitable devices and components for outputting the pattern to the displays 74. The circuit 72 can be an analog or digital circuit, or any suitable combination of analog and digital components configured to generate a display pattern in response to output from the sensor 78. The 72 circuit can include one or more non-programmable or programmable digital integrated circuits (ICs), such as field programmable gate arrays (FPGAs), application specific integrated circuits (ASICs), a microprocessor, microcontroller, standard logic components or any suitable combination thereof.

The sensor 78 detects at least one aspect of the physical orientation of the die, e.g., which side is facing up or down, whether the die has moved or is moving, rotational angle, or the like. The sensor 78 outputs one or more signals to the circuit 72 for triggering the generation of visual and/or audio displays. In response to the sensor outputs, the circuit 72 can change operational states of the die and/or produce display patterns, such as those disclosed herein.

The displays 74 can include any suitable devices, including LEDs, bulbs, LCDs or the like, for presenting the visual effects in response to signals received from the circuit 72.

The power source 76 is located inside the die, for powering the displays 74, and the circuit 72, and if necessary, the sensor 78. The power source 76 can be one or more off-the-shelf batteries having a suitable voltage, current rating and size for the die.

Figure 7:
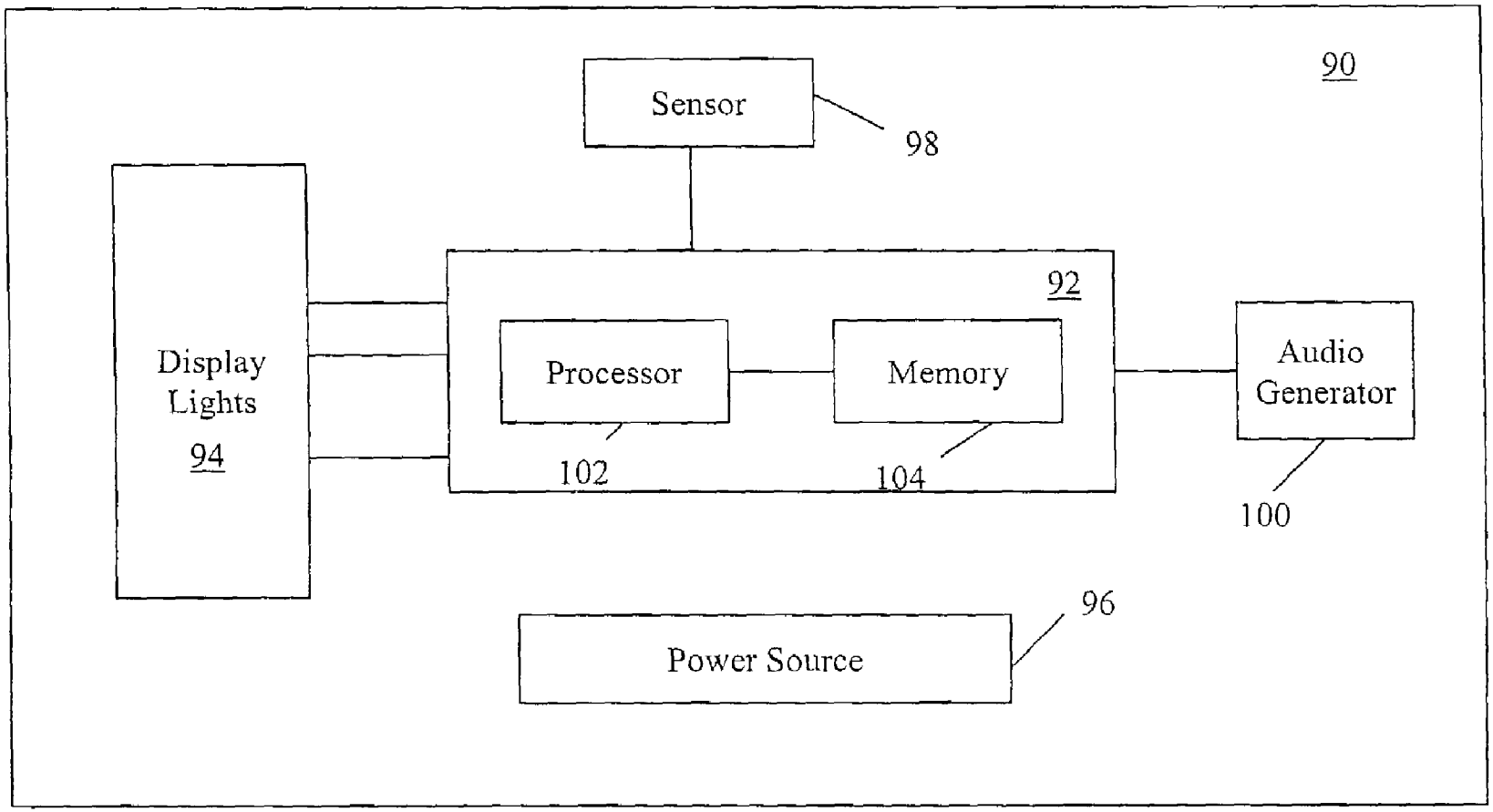
FIG. 7 is a block diagram depicting a second circuit includable in the preferred embodiment of the electronic die disclosed herein.

FIG. 7 is a block diagram depicting the electronic components 90 included in the preferred embodiment of the electronic die. The electronics 90 include an electronic control circuit 92, display lights 94, a power source 96, such as one or more batteries, a sensor 98, and an audio generator 100.

The control circuit 92 includes a processor 102 and a memory 104. The memory 104 stores information, such as a program and data, defining a display pattern for the lights 94, which can be the light emitting dots shown in FIG. 1, and audio generator 100, if it is included in the die. The processor 102 reads the stored information and causes the lights 94 to flash on and off according to the display pattern.

The processor 102 can be a microcontroller or microprocessor having a suitable bus size, such as 8-bits. The memory 104 can be any suitable solidstate memory device, such a random access memory (RAM), read only memory (ROM), electrically erasable programmable ROM (EEPROM), programmable ROM (PROM), or a combination of the aforementioned types of memory.

The processor 102 and memory 104 can be separate microchips, or can be integrated onto a single chip. Preferably, the processor 102 and memory 104 are a commercially-available, off-the-shelf microcontroller having onboard memory, such as a microcontroller from the COP8 family of controllers, available from National Semiconductor Corporation of Santa Clara, Calif.; specifically, part no. COP8SAA7, operating at three volts. When using a COP8 microcontroller, the display lights 94 and audio generator 100 are connected to one or more output ports of the microcontroller and the sensor 98 outputs are connected to an input port of the microcontroller.

Alternatively, the processor 102, memory 104, as well as other components (not shown) in the control circuit 92, can be built using other hardware technologies, such as one or more ASICs, FPGAs, or the like. The present invention is not limited to the particular electronic circuits or software disclosed herein.

The information stored in the memory 104 can include a computer software program executable by the processor 102 as well as data, such as tables of display codes and command codes for operating the lights 94 and audio generator 100, respectively. An exemplary computer program is disclosed herewith in the Computer Program Listing Appendix. The exemplary computer program is an assembly level program for a COP8 microcontroller. Among other things, it includes routines for flashing alternating display sequences by outputting display codes in predefined orders and at predefined times; producing noise with a piezoelectric device; and powering down into a halted state and powering up, based on input from the sensor 98. The exemplary program also includes data structures for storing tables of display codes that define which dots (or in other embodiments, display elements) are to be turned on.

Although Computer Program Listing Appendix discloses an assembly language program, the present invention is not limited to this particular program or language. Any suitable language can be used to implement the software, such as a high level structured programming language such as C++ or the like. Moreover, the invention also encompasses programs having additional or different functionality, other than that disclosed in Computer Program Listing Appendix. For example, in addition/alternative to storing display pattern software, the memory 104 can store game software that causes the die to present visual displays, sounds, audio instructions, or the like for playing a particular game. The progress of the game can be based on the outcome of each roll, which is provided by the sensor 98. In this embodiment, the memory 104 can also store game data, such as the results of a sequence of rolls, time periods, cumulative results of rolls, and so forth.

An advantage of the programmability of the control circuit is that the functionality of the die can be easily changed by revising the software. This permits multiple versions of die to be produced, with little, if any, change to the hardware. Thus, different versions of the die can be manufactured with relative ease, with each version having different display patterns and/or one or more different games programmed into them.

The sensor 98 indicates at least one aspect of the physical orientation of the die, e.g., which side is facing up, whether the die has moved or is moving, rotational angle, direction of rotation, or the like. In its preferred form, the sensor 98 is a gravity switch, such as the one shown in FIGS. 12A–B. Using a gravity switch, the sides facing up and down can be readily determined. In addition, the processor 102 can be programmed to detect signal transitions on the leads of the gravity switch in order to determine when the die is moving, e.g. being rolled or shaken.

The audio generator 100 can be any suitable device for making sounds and/or noises, and capable of being operated or driven by the control circuit 92. Preferably, the audio generator 100 includes an off-the-shelf piezoelectric speaker. Alternatively, the generator 100 can include a small conventional loudspeaker. The generator 100 can also include any necessary circuitry for producing a desired sound, such as amplifiers, or voice and/or music synthesis chips, that are either integrated with the control circuit 92 or separate chips. With separate synthesis chips, the chips can be interfaced to and controlled by a microcontroller or any other equivalent circuitry included in the control circuit 92. In this arrangement, the audio generator 100 can be configured by the control circuit 92 to produce speech (even in different languages), songs, music, sound effects, and the like. The control circuit 92 can include one or more software routines for operating the audio generator 100.

The power source 96 provides electrical power to the other components, such as the lights 94, the memory 104, the audio generator 100, and the processor 102. As described herein above, the power source is preferably one or more batteries.

To ensure that the die is suitable for playing dice games, the components 92–104 are securely mounted or embedded within the interior of the die to withstand being thrown, shaken or tossed. The mounting or encasement techniques described above in connection with FIGS. 2 and 5, respectively, can be used.

Figure 8:
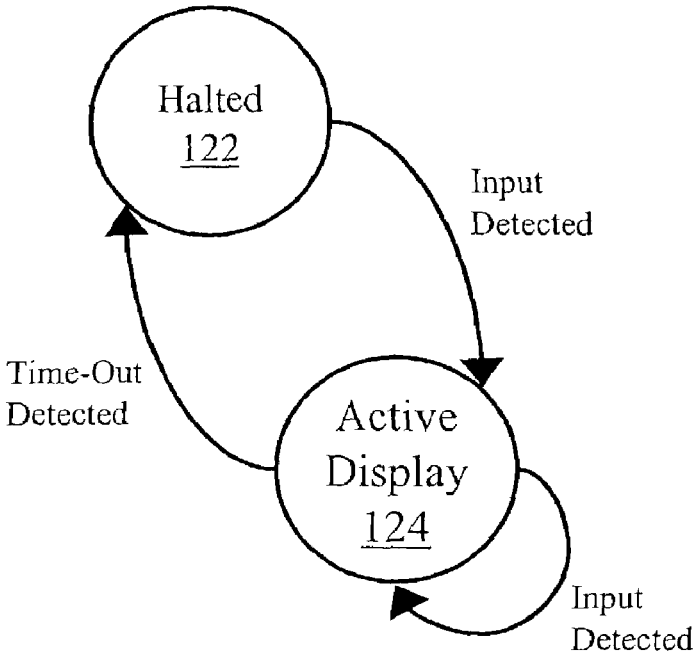
FIG. 8 is a state diagram illustrating the operation of the electronic die in accordance with the preferred embodiment of the invention.

FIG. 8 is a state diagram 120 illustrating the operation of the electronic die 10 in accordance with the preferred embodiment of the invention. The die 10 has two states: a halted state 122 or an active display state 124. On power-up, the die 10 enters the active display state 124. In this state, the die displays visual/audio effects by activating the lighted elements on its sides and/or operating the internal audio generator. The die 10 also performs game routines to permit the user to play specific games, if programmed to do so. Exemplary operational steps that can be executed in the active state 124 are described in connection with FIG. 10.

The die transitions to the halted state 122 upon the occurrence of a time-out. After executing the display and game functions in the active state 124, the die 10 waits for a period of time. If no transition on sensor inputs is detected during this period, i.e., the die 10 is not being shaken, rolled or otherwise used, the time-out occurs and the die enters the halted state 122. On the other hand, if a sensor input transition is detected, the die 10 remains in the active display state 124 and continues to perform display and game routines.

In the halted state 122, the die goes to sleep, entering a power down mode. This increases battery life. Temporary variables stored in memory, such as game variables, can be reset or cleared. The die 10 exits the halted state 122 and returns to the active state 124 upon detecting a transition on the sensor inputs.

The software program included in the Computer Program Listing Appendix provides an exemplary implementation of the two-state operation of a programmable electronic die in accordance with an embodiment of the invention.

Figure 9:
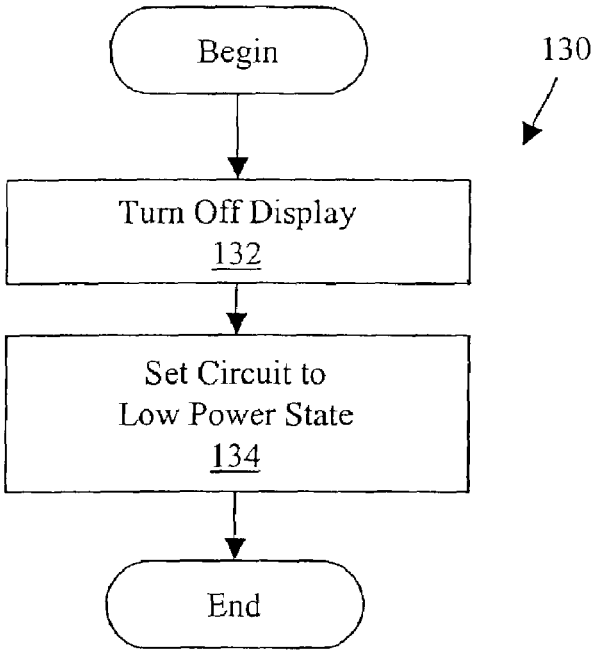
FIG. 9 is a flow chart diagram illustrating the operational activities of the die while in the halted state.

FIG. 9 is a flowchart 130 illustrating the operational activities of the die 10 while in the halted state. Upon entering the halted state, the controller turns off the display, both the display lights 94 and audio generator 100, if it is included, to save power. The processor 102 then sets the control circuit 92 to a low power state to further reduce power consumption. The die 10 remains in this halted state until it is activated by a transition to the active display state. The transition occurs when a signal transition is detected on an output from the sensor 98.

Figure 10:
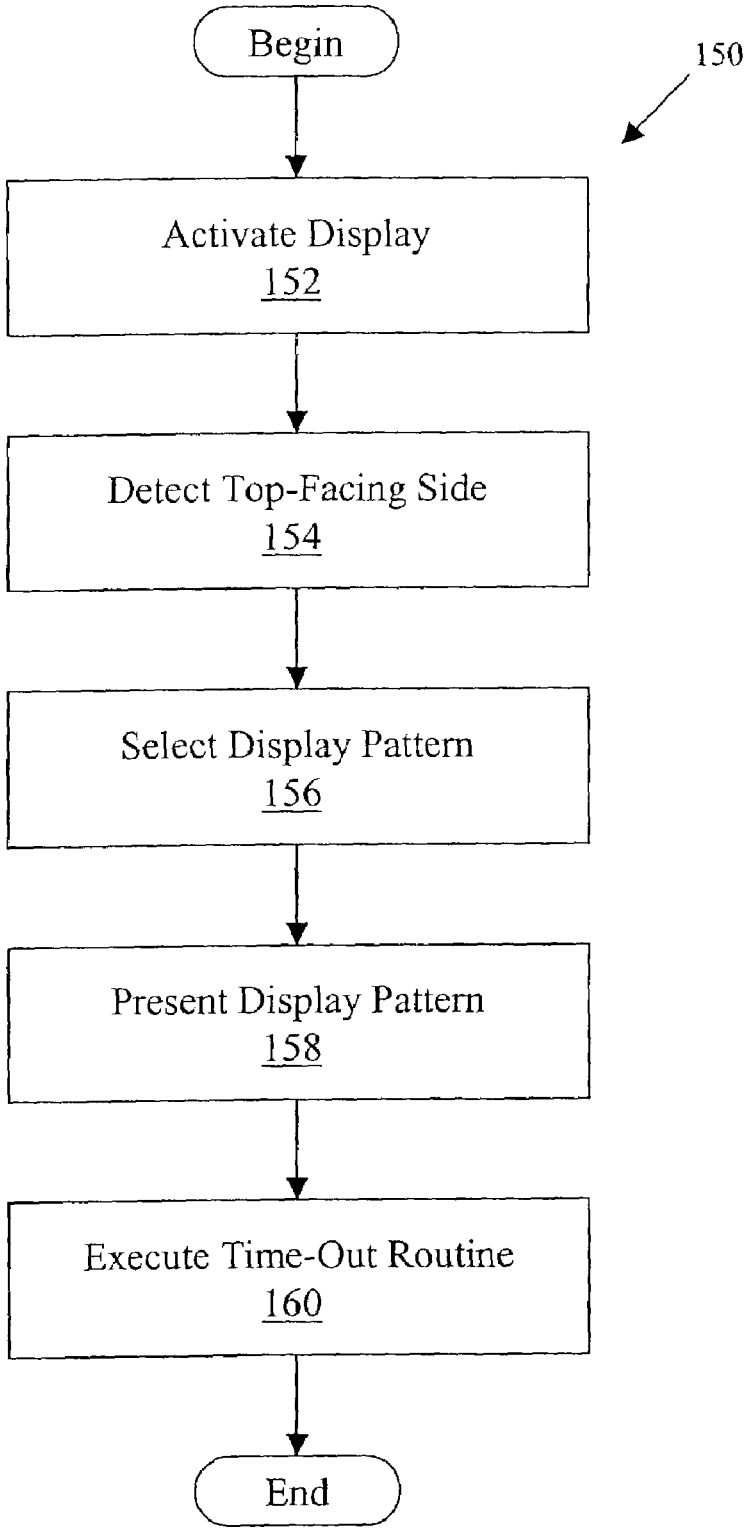
FIG. 10 is a flow chart diagram illustrating the operational activities of the die while in the active display state.

FIG. 10 is a flow chart diagram 150 illustrating an exemplary operational scenario of the die 10 while in the active display state 124. In step 152, the circuitry activates the visual and audio displays. To do this, the electronic circuitry can begin flashing the lights on and off in various patterns. In addition, if audio effects are used, the control circuitry can activate the audio generator to produce noises or synthesized speech or music. If a game is programmed into the die 10, the controller resets the game routine to begin a new game.

In step 154, the circuitry detects the top-facing side of the die 10 from the output of the gravity switch sensor.

In step 156, the display pattern is selected based on the output of the gravity switch. The display pattern can be selected as a function of the output of the gravity switch. For example, the top-facing side can remain lighted with the bottom-facing side turned off, while the other sides flash a predefined pattern. If an audio generator is included, then an audio pattern is included in the display pattern and is also selected for presentment.

In step 158, the die presents the display pattern. The visual display is flashed and sound is generated, according to the selected display pattern. If voice synthesis is used, the audio generator can annunciate the number or symbol displayed by the top-facing side. Additionally, game variables can be updated in memory and any game results can be visually displayed or audibly presented.

After execution of the display pattern, the processor executes a timeout routine if the die 10 is not moved, shaken or tossed within a predefined time period, e.g., about 10 seconds (step 160). Upon completion of the timeout routine, the die 10 returns to the halted state, where it powers down into a reduced power consumption state.

FIGS. 11A–B and 12A–B illustrate perspective and cross-sectional views of exemplary gravity switches includable in the various embodiments of the electronic die disclosed herein.

Figure 11A:
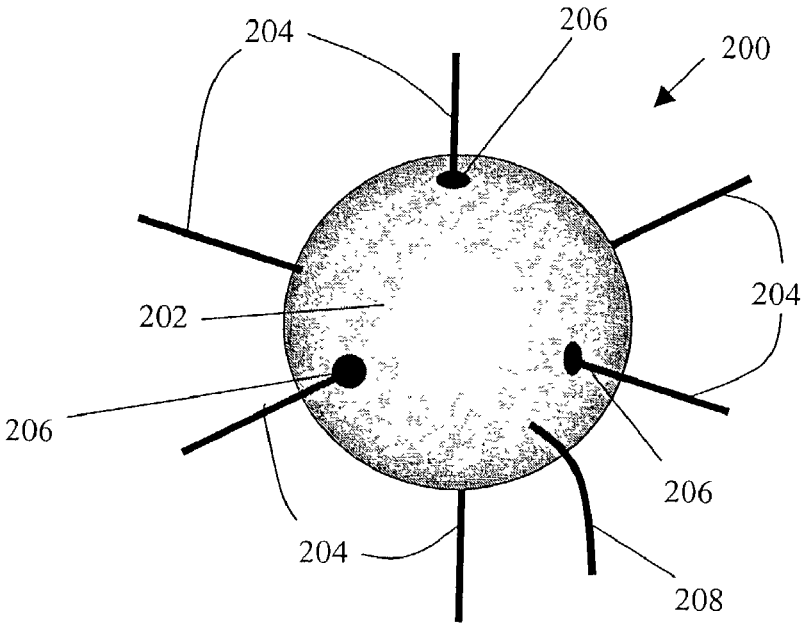
FIGS. 11A–B and 12A–B illustrate perspective and cross-sectional views of exemplary gravity switches includable in the electronic dice disclosed herein.

FIG. 11A is a perspective view of spherical gravity switch 200. The switch 200 includes a conductive shell 202 forming an enclosed space and a plurality of conductors 204 passing through the shell 202 into the enclosed space. The conductive shell 202 can be made of metal, such as aluminum or copper. Each of the conductors 204 corresponds to a face of the die. The switch 200 is positioned inside the die so that the conductors 204 are aligned generally perpendicular to and opposite their corresponding faces. Thus, when the switch 200 is properly mounted inside the die, the conductor 204 at the bottom of the switch 200 corresponds to the top side of the die, when the die is lying on one of its sides. Each of the conductors 204 is connected to a respective input of the electronic control circuit.

Insulators 206 electrically isolate the conductors 204 from the shell 202. The insulators 206 can be non-conductive grommets, plastic wire insulation, or the like. A reference conductor 208 provides an electrical path between the shell 202 and ground. Alternatively, the conductor 208 can provide a reference voltage.

Figure 11B:
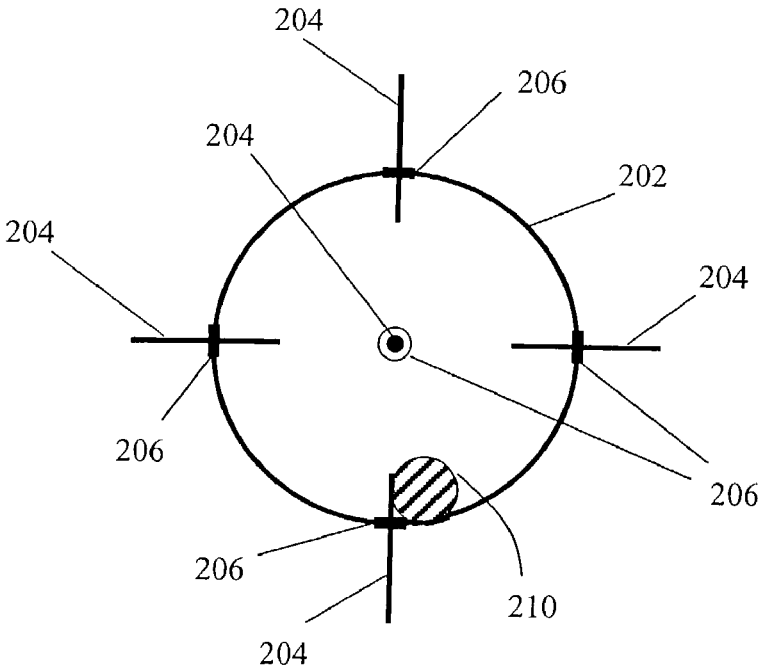

As shown in the cross-sectional view of FIG. 11B, a freely movable conductor 210 is placed inside the shell 202. As shown, the freely movable conductor 210 is preferably a conductive ball, such a metal ball bearing. Other movable conductors, such as a conductive liquid, can be used instead.

The movable conductor 210 moves around inside the shell 202 as the die is shaken or tossed. When the die comes to rest on one of its faces, the movable conductor 210 comes to rest at the bottom of the shell 202, against the conductor 204 corresponding to the upward face. This establishes an electrical path between the conductor 204 and the shell 202. This essentially closes a switch between the bottom conductor 204 and reference conductor 208, thus sending a signal to the electronic circuit indicating which facet is up. The signal can trigger the execution of a display pattern.

Figure 12A:
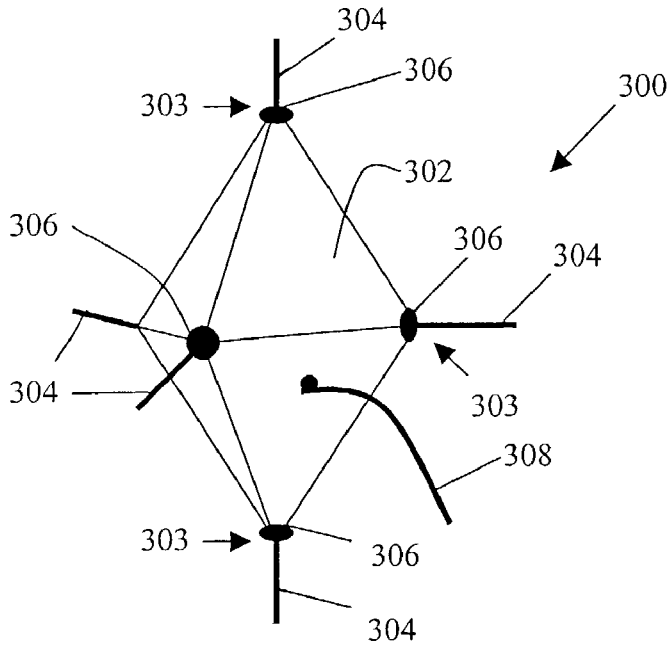

FIG. 12A is a perspective view of a preferred gravity switch 300 having a polyhedron-shaped conductive shell 302. The switch 300 functions is the same manner as the spherical switch 200, but may lend itself to improved manufacturability, as the shell 302 can be formed from a flat sheet of conductive material, such as aluminum or copper, and then folded and soldered or otherwise fixed into the desired shape. The polyhedron shell 302 has a sufficient number of sides so that there is at least one point 303 corresponding to each side of the die. The conductors 304 are located at the points 303. The exemplary polyhedron shape shown in FIGS. 12A–B has six points 303, and is therefore suitable for use with a six-sided die.

The conductors 304 pass through the shell 302 into its interior. Each of the conductors 304 corresponds to a face of the die. The switch 300 is positioned inside the die so that the conductors 304 are aligned generally perpendicular to and opposite their corresponding faces. Thus, when the switch 300 is properly mounted inside the die, the conductor 304 at the bottom of the switch 300 corresponds to the top side of the die, when the die is lying on one of its sides.

Insulators 306 electrically isolate the conductors 304 from the shell 302. The insulators 306 can be non-conductive grommets, plastic wire insulation, or the like.

A reference conductor 308 provides an electrical path between the shell 302 and ground. Alternatively, the reference conductor 308 can provide a reference voltage.

Figure 12B:
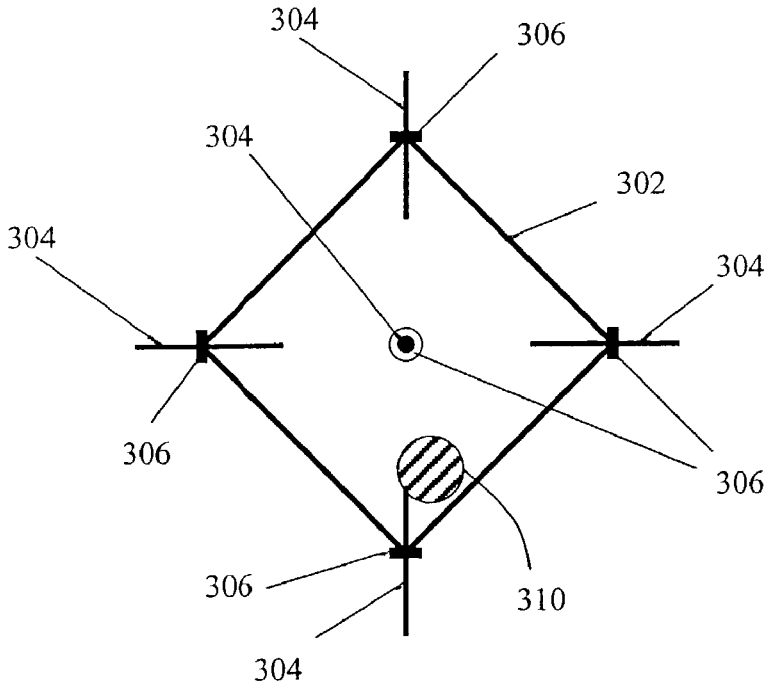

As shown in the cross-sectional view of FIG. 12B, a freely movable conductor 310 is placed inside the shell 302. The movable conductor 310 moves around inside the shell 302 as the die is shaken or tossed. When the die comes to rest on one of its faces, the movable conductor 310 comes to rest against the bottom conductor 304 corresponding to the upward face, establishing an electrical path between the conductor 304 and the shell 302. This essentially closes a switch between the bottom conductor 304 and reference conductor 308, thus sending a signal to the electronic circuit indicating which facet is up. The signal can trigger execution of a display pattern.

When the processor 102 (e.g., a microcontroller or microprocessor) is included in the electronic circuit, each conductor 204 or 304 can be connected to a respective pin of an input port. The processor 102 can poll the input port to detect signal transitions, or alternatively, can generate an interrupt in response to a signal transition on one of the pins. The polling routine and/or interrupt routine executed by the processor 102 triggers the execution of software instructions for the display patterns, games, and so forth.

While specific embodiments of the present invention have been shown and described, it will be apparent to those skilled in the art that the disclosed invention may be modified in numerous ways and may assume many embodiments other than those specifically set out and described above. Accordingly, the scope of the invention is indicated in the appended claims, and all changes that come within the meaning and range of equivalents are intended to be embraced therein.

The invention claimed is:

1. An electronic die for randomly selecting an outcome that is a number between one and six, comprising:

a six-sided, cube-shaped body adapted to be rolled by a user to decide the outcome;

one discrete LED centered on a first side of the body, representing the number one;

two discrete LEDs located in diagonally opposite corners of a second side of the body, representing the number two;

three discrete LEDs located along a diagonal of a third side of the body, representing the number three, one of the three LEDs being centered on the third side and two of the three LEDs being located in diagonally opposite corners of the third side;

four discrete LEDs located on a fourth side of the body, representing the number four, each of the four LEDs being located in a respective corner of the fourth side;

five discrete LEDs located on a fifth side of the body, representing the number five, one of the five LEDs being centered on the fifth side and each of the other five LEDs being located in a respective corner of the fifth side;

six discrete LEDs located on a sixth side of the body, representing the number six, three of the six LEDs being aligned in a first row located along a first edge of the sixth side and the other three of the six LEDs being aligned in a second row located along a second edge of the sixth side, the second edge being opposite the first edge, whereby the electronic die includes a total of twenty-one LEDs;

an electronic circuit, located within the body, for causing the twenty-one LEDs on the sides of the body to flash in a predetermined pattern;

a sensor, located within the body, for triggering the electronic circuit to flash the twenty-one LEDs according to the predetermined pattern in response to the electronic die being rolled; and at least one battery, located in the cube-shaped body, for powering the electronic circuit and the twenty-one LEDs;

wherein after the electronic die is rolled and comes to a stop, the outcome of the roll is the number of discrete LEDs on an upward-facing side of the body.

2. The electronic die of claim 1, wherein the sensor includes:

a gravity switch, located within the cube-shaped body and operatively coupled to the electronic circuit, for indicating which of the sides is facing up.

3. The electronic die of claim 2, wherein the gravity switch and the electronic circuit are configured to cause the LEDs on the upward-facing side of the electronic die to remain continuously illuminated during operation of the electronic die.

4. The electronic die of claim 2, further comprising an audio generator for announcing a voice message corresponding to the upward-facing side of the electronic die indicated by the gravity switch.

5. The electronic die of claim 2, wherein the gravity switch comprises:

a conductive shell forming an enclosed space;

a plurality of conductors located within the enclosed space and electrically isolated from the shell, each of the conductors corresponding to a side of the electronic die; and means for establishing an electrical path between one of the conductors and the shell when the side corresponding to the one of the conductors is up.

6. The electronic die of claim 5, wherein the establishing means includes a freely movable conductor selected from the group consisting of a conductive bead and a conductive liquid.

7. The electronic die of claim 1, further comprising an electronic noisemaker located within the cube-shaped body.

8. The electronic die of claim 1, wherein the cube-shaped body is solid and embeds the electronic circuit, the sensor, and the at least one battery.

9. The electronic die of claim 8, wherein the solid body is cast resin or injection molded plastic.

10. The electronic die of claim 1, wherein the volume of the cube-shaped body is less than one cubic inch.

11. An electronic die, comprising:

a body having a plurality of sides, adapted to be tossed by a user for randomly selecting an outcome from a predetermined set of possible outcomes, the outcome appearing on an upward-facing side of the body after the die is tossed and comes to rest, each of the sides representing a predetermined discrete outcome that is distinct from the outcomes represented by the other sides of the body;

a plurality of illuminable displays for displaying the outcomes on the sides, each of the illuminable displays being visible on a predetermined respective one of the sides;

an electronic circuit, contained within the interior of the body and comprising one or more integrated circuits mounted on a circuit board, for causing one or more of the illuminable displays to flash in a predetermined pattern;

means, contained within the interior of the body, for triggering the electronic circuit in response to the electronic die being moved;

a gravity switch, located within the body and operatively coupled to the electronic circuit, for indicating which of the sides is facing up; and one or more batteries, contained within the interior of the body, for powering the displays and the electronic circuit;

wherein the gravity switch and the electronic circuit are configured to cause the illuminable display visible on the upward-facing side of the electronic die to illuminate continuously while at the same time the illuminable displays on the other sides flash in the predetermined pattern.

12. The electronic die of claim 11, further comprising an audio generator.

13. The electronic die of claim 12, wherein the audio generator is configured to announce a voice message corresponding to the upward-facing side of the electronic die indicated by the gravity switch.

14. The electronic die of claim 11, wherein the body includes an enclosed compartment for containing the circuit and batteries.

15. The electronic die of claim 11, wherein the body is a solid plastic body embedding the circuit and batteries.

16. The electronic die of claim 15, wherein the solid plastic body is cast resin or injection molded plastic.

17. The electronic die of claim 11, wherein the volume of the body is less than one cubic inch.

18. The electronic die of claim 11, wherein the gravity switch comprises:

a conductive shell forming an enclosed space;

a plurality of conductors located within the enclosed space and electrically isolated from the shell, each of the conductors corresponding to a side of the electronic die; and means for establishing an electrical path between one of the conductors and the shell when the side corresponding to the one of the conductors is up.

19. The electronic die of claim 18, wherein the establishing means includes a freely movable conductor selected from the group of consisting of a conductive bead and a conductive liquid.

20. The electronic die of claim 11, further comprising:

at least one light source contained internally within the body for illuminating the illuminable displays.

21. An electronic die for randomly selecting an outcome that is a number between one and six, comprising:

a six-sided, cube-shaped body adapted to be rolled by a user to decide the outcome;

a first side representing the number one;

two discrete LEDs located along opposite edges of a second side of the body, representing the number two;

three discrete LEDs located in a row on a third side of the body, representing the number three;

four discrete LEDs located on a fourth side of the body, representing the number four, each of the four LEDs being located in a respective corner of the fourth side;

five discrete LEDs located on a fifth side of the body, representing the number five, one of the five LEDs being centered on the fifth side and each of the other five LEDs being located in a respective corner of the fifth side;

six discrete LEDs located on a sixth side of the body, representing the number six, three of the six LEDs being aligned in a first row located along a first edge of the sixth side and the other three of the six LEDs being aligned in a second row located along a second edge of the sixth side, the second edge being opposite the first edge, whereby the electronic die includes a total of at least twenty LEDs;

an electronic circuit, located within the body, for causing the at least twenty LEDs on the sides of the body to flash in a predetermined pattern;

a sensor, located within the body, for triggering the electronic circuit to flash the at least twenty LEDs according to the predetermined pattern in response to the electronic die being rolled; and at least one battery, located in the cube-shaped body, for powering the electronic circuit and the at least twenty LEDs;

wherein after the electronic die is rolled and comes to a stop, the outcome of the roll is the number of discrete LEDs on an upward-facing side of the body.

22. The electronic die of claim 21, wherein the cube-shaped body is a solid plastic body embedding the circuit and batteries.

23. The electronic die of claim 22, wherein the solid plastic body is cast resin or injection molded plastic.

24. The electronic die of claim 21, wherein the volume of the cube-shaped body is less than one cubic inch.

25. The electronic die of claim 21, further comprising an audio generator.

26. The electronic die of claim 25, wherein the audio generator is configured to announce a voice message corresponding to the upward-facing side of the electronic die indicated by the gravity switch.

27. The electronic die of claim 21, wherein the gravity switch comprises:

a conductive shell forming an enclosed space;

a plurality of conductors located within the enclosed space and electrically isolated from the shell, each of the conductors corresponding to a side of the electronic die; and means for establishing an electrical path between one of the conductors and the shell when the side corresponding to the one of the conductors is up.

28. The electronic die of claim 27, wherein the establishing means includes a freely movable conductor selected from the group of consisting of a conductive bead and a conductive liquid.

29. An electronic die having a plurality of sides, comprising:

a unit including a plurality of illuminable displays positioned relative to one another so that each of the illuminable displays is visible on a respective exterior side of the electronic die, an electronic circuit for operating the illuminable displays, and a power source for powering the illuminable displays and the electronic circuit;

a body defining the exterior shape and size of the electronic die and embedding the unit inside the electronic die with the illuminable displays visible on the respective exterior sides of the electronic die; and a gravity switch, located in the body, for indicating which of the sides is up, the gravity switch comprising a conductive shell forming an enclosed space, a plurality of conductors located within the enclosed space and electrically isolated from the shell, each of the conductors corresponding to a side of the die, and means for establishing an electrical path between one of the conductors and the shell when the side corresponding to the one of the conductors is up.

30. The electronic die of claim 29, wherein the establishing means includes a freely movable conductor selected from the group consisting of a conductive bead and a conductive liquid.

* * * * *